United States Patent [19]

Ishida et al.

[11] Patent Number: 4,462,358

[45] Date of Patent: Jul. 31, 1984

[54] THROTTLE VALVE

[75] Inventors: Takashi Ishida, Ohi; Noboru Tominari, Tokyo, both of Japan

[73] Assignee: Mikuni Kogyo Kabushiki Kaisha, Tokyo, Japan

[21] Appl. No.: 378,285

[22] Filed: May 14, 1982

[30] Foreign Application Priority Data

May 25, 1981 [JP] Japan ..... 56-78051

[51] Int. Cl.[3] ..... F02M 9/08

[52] U.S. Cl. ..... 123/337

[58] Field of Search ..... 123/337; 261/65

[56] References Cited

U.S. PATENT DOCUMENTS 3,785,628 1/1974 Lang ..... 261/65

3,903,215 9/1975 Cole et al. ..... 261/65

FOREIGN PATENT DOCUMENTS 210295 4/1908 Fed. Rep. of Germany ..... 123/337

*Primary Examiner*—William A. Cuchlinski, Jr.

*Attorney, Agent, or Firm*—Owen, Wickersham & Erickson

[57] ABSTRACT

A throttle valve disposed within the intake bore of an internal combustion engine. The valve thickness is large, preferably more than about 1.5 mm and less than 1/10 of the valve diameter. The full closed angle of the valve is less than 5°. The circumferential edge of the valve has a roundness having a radius less than about five times as large as the valve thickness. When the valve is fully closed, there is a clearance L of about 1/10,000 to 5/1,000 of the intake bore diameter between the circumferential edge of the valve and the inner surface of the intake bore. The valve reduces the degree of air flow change at small opening angles of the valve as in the idling or low-speed operation of the engine so as to reduce the change of air flow caused by the change of the valve opening. Thus, an optimum air-fuel ratio in a range of small opening angles of the valve can be easily maintained.

2 Claims, 3 Drawing Figures

THROTTLE VALVE

BACKGROUND OF THE INVENTION

1. Field of the Invention

The present invention relates to a throttle valve which is relatively thick and has a round circumferential edge. More particularly, it relates to a throttle valve disposed within the intake bore of an internal combustion engine, which valve is adapted to reduce the degree of air flow change at small opening angles of the valve as in the idling or low-speed operation of the engine so as to reduce the change of air flow caused by the change of the valve opening.

2. Description of the Prior Art

Usually, a throttle valve of a butterfly type as shown in FIG. 1 is disposed within the intake bore of an internal combustion engine. Fuel from a main fuel system or a slow fuel system is mixed with air, the flow of which depends upon the opening of the throttle valve, and an optimum mixture of fuel and air is supplied to the combustion chamber of the engine. When the conventional throttle valve is fully closed, the clearance L between the valve 1 and the intake bore 2 is usually about 0.005 mm to 0.03 mm which is the smallest possible clearance that prevents the valve from sticking. The full closed angle $\theta$ of the throttle valve is in a range of 5° to 20°, and the thickness t, thereof is 1.0 mm to 1.5 mm. According to such a construction, air flow is zero when the valve is fully closed and it sharply increases therefrom as the valve is opened, as shown by the dot-dash curve in FIG. 3, by the effect of the clearance between the valve 1 and the intake bore 2, the initial angle of the valve, etc. This means that the relationship between the change of the valve opening and the change of air flow is critical, and an error in the valve opening exercises a great influence upon an error in air flow. Therefore, a compensating means is used in addition to the slow fuel system in order to obtain an approximation to a desired air-fuel ratio at small opening angles of the valve. However, such an effort has not yet obviated the aforesaid critical relationship.

BRIEF SUMMARY OF THE INVENTION

It is an object of the present invention to provide a throttle valve which has obviated the aforesaid disadvantage of the prior art.

Such and other objects have been attained by a throttle valve which is improved in shape so as to reduce the degree of air flow change at small opening angles of the valve, thereby reducing the change of air flow caused by the change of the valve opening.

DETAILED DESCRIPTION

The present invention will now be described in detail with reference to the attached drawings.

Figure 1:
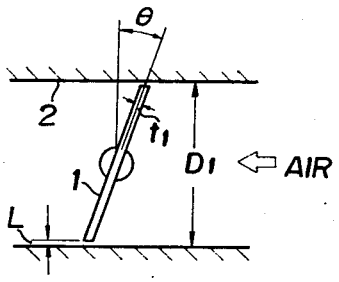
FIG. 1 PRIOR ART
FIG. 1 is a side view of a conventional throttle valve.
Figure 2:
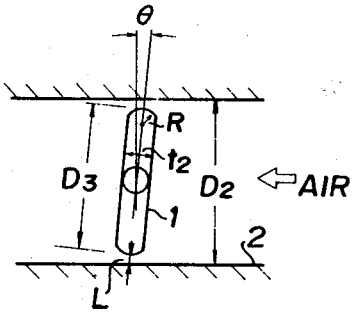
FIG. 2 is a side view of a throttle valve according to the present invention.

As shown in FIG. 2, a throttle valve 1 of the present invention is thicker than a conventional throttle valve, and has a round circumferential edge, the full closed angle thereof being less than 5°. The valve thickness $t_2$ is at least 1.5 mm, preferably 1/30 to 1/10 of the valve diameter $D_3$. The circumferential edge of the throttle valve 1 has a roundness having a radius R less than about five times, preferably between three and four times, as large as the valve thickness $t_2$. Said radius R should not be more than about five times as large as the valve thickness $t_2$ because in such a case the diameter of the valve shaft becomes large and the valve offers a large resistance to air when it is fully opened. When the throttle valve 1 is fully closed, there is a clearance L of about 1/10,000 to 5/1,000 of the intake bore diameter $D_2$ between the circumferential edge of the throttle valve 1 and the inner surface of the intake bore 2.

Figure 3:
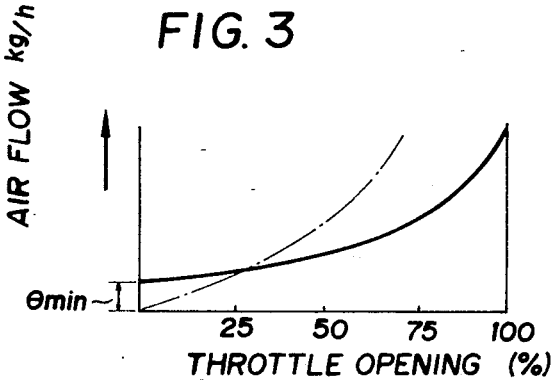
FIG. 3 is a diagram showing the relationship between the valve opening and air flow.

In the illustrated embodiment in which the intake bore diameter $D_2$ is 50 mm, the clearance L between the throttle valve 1 and the intake bore 2 is 0.03 mm, the full closed angle $\theta$ of the throttle valve 1 being 0°, the valve thickness $t_2$ being 3 mm, and the radius R being 10 mm. According to such a construction, there is a minimum air flow Q min even when the throttle valve 1 is fully closed, and the degree of air flow change at small opening angles of the valve is small, as shown by the solid curve in FIG. 3. Therefore, an error in air flow is small relative to an error in the valve opening. It is to be noted that FIG. 3 shows the change of air flow relative to the valve opening when the pressure difference is constant.

According to the present invention, the throttle valve is relatively thick, the full closed angle thereof is less than 5°, and the circumferential edge thereof is round as mentioned above. Therefore, the degree of air flow change relative to the valve opening is reduced, and an optimum air-fuel ratio in a range of small opening angles of the valve can be easily maintained. Particularly in a fuel priority system, as disclosed in U.S. patent application Ser. No. 228973, in which the flow rate of fuel depends only upon the operation of the accelerator by the operator (driver) and the opening of the throttle valve is determined so as to give an optimum air flow calculated on the basis of fuel flow input and other information (temperature of cooling water, temperature of the cylinder head, atmospheric temperature, atmospheric pressure, fuel supply line pressure, etc.), the opening of the throttle valve is controlled by an actuator therefor, and a stepping motor, DC servo motor, etc. may be used as the actuator because the requirement for the precision of the valve opening set by the actuator becomes easier as an error in air flow relative to an error in the valve opening is reduced. In this case, the throttle valve of the present invention has the advantage, over the conventional throttle valve, that is is not necessary to use a high-resolution encoder or a high-precision potentiometer as a position feedback sensor for precisely confirming the actuator position, that is, the valve opening.

As many apparently widely different embodiments of the present invention may be made without departing from the spirit and scope thereof, it is to be understood that the invention is not limited to the specific embodiments thereof except as defined in the appended claims.

What is claimed is:

1. A throttle valve disposed within the intake bore of an internal combustion engine, said valve comprising a movable plate member having a thickness that is more than 1.5 mm and less than about 1/10 of its diameter, the circumferential edge of the valve being rounded with a radius less than about five times as large as said valve thickness, and the full closed angle of the valve being less than 5° relative to a plane forming a right angle with the center line of the intake bore.

2. A throttle valve as claimed in claim 1, wherein there is a clearance L of about 1/10,000 to 5/1,000 of the intake bore diameter between said circumferential edge of the valve and the inner surface of said intake bore when the valve is fully closed.

* * * * *